US009961991B1

(12) United States Patent
Chen

(10) Patent No.: US 9,961,991 B1
(45) Date of Patent: May 8, 2018

(54) DESKTOP LIFTABLE PLATFORM

(71) Applicant: YING LIANG HEALTH TECH. CO., LTD., Taoyuan (TW)

(72) Inventor: Chih-Liang Chen, Taoyuan (TW)

(73) Assignee: Ying Liang Health Tech. Co., Ltd., Taoyuan (TW)

( * ) Notice: Subject to any disclaimer, the term of this patent is extended or adjusted under 35 U.S.C. 154(b) by 0 days. days.

(21) Appl. No.: 15/387,998

(22) Filed: Dec. 22, 2016

(51) Int. Cl.

| | |
|---|---|
| ***A47B 85/00*** | (2006.01) |
| ***A47B 21/02*** | (2006.01) |
| ***A47B 9/16*** | (2006.01) |
| ***A47B 21/03*** | (2006.01) |

(52) U.S. Cl.
CPC ..... *A47B 21/02* (2013.01); *A47B 9/16* (2013.01); *A47B 21/0314* (2013.01); *A47B 2021/0335* (2013.01); *A47B 2200/0041* (2013.01); *A47B 2200/0056* (2013.01)

(58) Field of Classification Search
CPC ..... A47B 21/02; A47B 21/0314; A47B 9/16; A47B 2021/0335
See application file for complete search history.

(56) References Cited

U.S. PATENT DOCUMENTS

| | | | | | |
|---|---|---|---|---|---|
| 2,531,880 | A * | 11/1950 | Herring | A47B 21/02 | 108/117 |
| 3,938,766 | A * | 2/1976 | Herbolsheimer | A47B 21/02 | 108/147 |
| 4,637,322 | A * | 1/1987 | Hampshire | A47B 9/16 | 108/102 |
| 5,005,492 | A * | 4/1991 | Ogino | A47B 21/02 | 108/145 |
| 5,746,138 | A * | 5/1998 | Hirose | B25J 9/106 | 108/143 |
| 5,996,961 | A * | 12/1999 | Johnson | A47B 9/16 | 248/157 |
| 9,504,316 | B1 * | 11/2016 | Streicher | A47B 21/02 | |
| 9,615,655 | B1 * | 4/2017 | Huang | A47B 9/16 | |
| 9,635,929 | B1 * | 5/2017 | Wu | A47B 9/16 | |
| 9,681,746 | B1 * | 6/2017 | Chen | A47B 9/16 | |
| 2006/0037518 | A1 * | 2/2006 | Lopez Alba | A47B 9/16 | 108/145 |
| 2008/0203865 | A1 * | 8/2008 | Chouinard | A47B 21/02 | 312/223.3 |
| 2009/0095874 | A1 * | 4/2009 | Young | A47B 21/0314 | 248/575 |

(Continued)

*Primary Examiner* — Hanh V Tran
(74) *Attorney, Agent, or Firm* — Muncy, Geissler, Olds & Lowe, P.C.

(57) ABSTRACT

A desktop liftable platform has a base, a supporting frame, a platform, and a driving device. The base has two side beams and a connecting beam connected to rear ends of the side beams. The supporting frame is connected to the base and has two pivot anus connected to the side beams adjacent to front ends of the side beams. The platform is connected to the pivot arms over the base. The driving device is connected to the base and the supporting frame and has a driving motor, two slide groups, and two swing arms. The driving motor is deposited on the base. The slide groups are connected to and are driven by the driving motor. The swing arms are connected to the pivot arms and the slide groups, and are rotated relative to the base by the driving motor to enable the platform to move relative to the base.

10 Claims, 9 Drawing Sheets

(56) References Cited

U.S. PATENT DOCUMENTS

| | | | | |
|---|---|---|---|---|
| 2013/0139736 | A1* | 6/2013 | Flaherty | A47B 9/18 108/106 |
| 2015/0289641 | A1* | 10/2015 | Ergun | A47B 9/16 108/42 |
| 2016/0084432 | A1* | 3/2016 | Chuang | F16M 13/022 108/21 |
| 2017/0196351 | A1* | 7/2017 | Failing | A47B 21/02 |
| 2017/0290413 | A1* | 10/2017 | Hu | A47B 21/02 |

* cited by examiner

DESKTOP LIFTABLE PLATFORM

BACKGROUND OF THE INVENTION

1. Field of the Invention

The present invention relates to a desktop liftable platform, and more particularly to a desktop liftable platform that may be deposited on a top of a table, and a computer may be deposited on the desktop liftable platform.

2. Description of Related Art

A conventional table has a fixed height, so for people of different heights and sizes, the fixed height of the conventional table cannot be applied to each person, and people may feel unconformable after use for a long time and may feel tired easily. In addition, when the height of the conventional table doesn't fit with a user, this makes the user prone to adopt incorrect postures and then induces pathological changes of muscles and joints of cervical vertebra or lumbar vertebra. Even if the height of the conventional table fits with the user, the user remains seated on a chair to use a computer, to read or to work at the conventional table for a long time, and this will cause poor blood circulation in the lower limbs of the user, resulting in severe cardiovascular diseases. Therefore, when using the fixed-height conventional table and remaining seated for a long time, the user will lack activities, which easily leads to the above-mentioned diseases.

To overcome the above-mentioned shortcomings, the present invention provides a desktop liftable platform to mitigate or obviate the aforementioned problems.

SUMMARY OF THE INVENTION

The main objective of the invention is to provide a desktop liftable platform that may be deposited on a top of a table, and a computer may be deposited on the desktop liftable platform.

The desktop liftable platform in accordance with the present invention has a base, a supporting frame, a platform, and a driving device. The base has two side beams and a connecting beam connected to rear ends of the side beams. The supporting frame is connected to the base and has two pivot anus pivotally connected to the side beams adjacent to front ends of the side beams. The platform is connected to the pivot arms of the supporting frame over the base. The driving device is connected to the base and the supporting frame and has a driving motor, two slide groups, and two swing arms. The driving motor is deposited on the base. The slide groups are connected to and are driven by the driving motor. The swing arms are connected to the pivot arms of the supporting frame and the slide groups, and are rotated relative to the base by the driving motor to enable the platform to move upwardly or downwardly relative to the base.

Other objectives, advantages and novel features of the invention will become more apparent from the following detailed description when taken in conjunction with the accompanying drawings.

DETAILED DESCRIPTION OF PREFERRED EMBODIMENT

Figure 1:
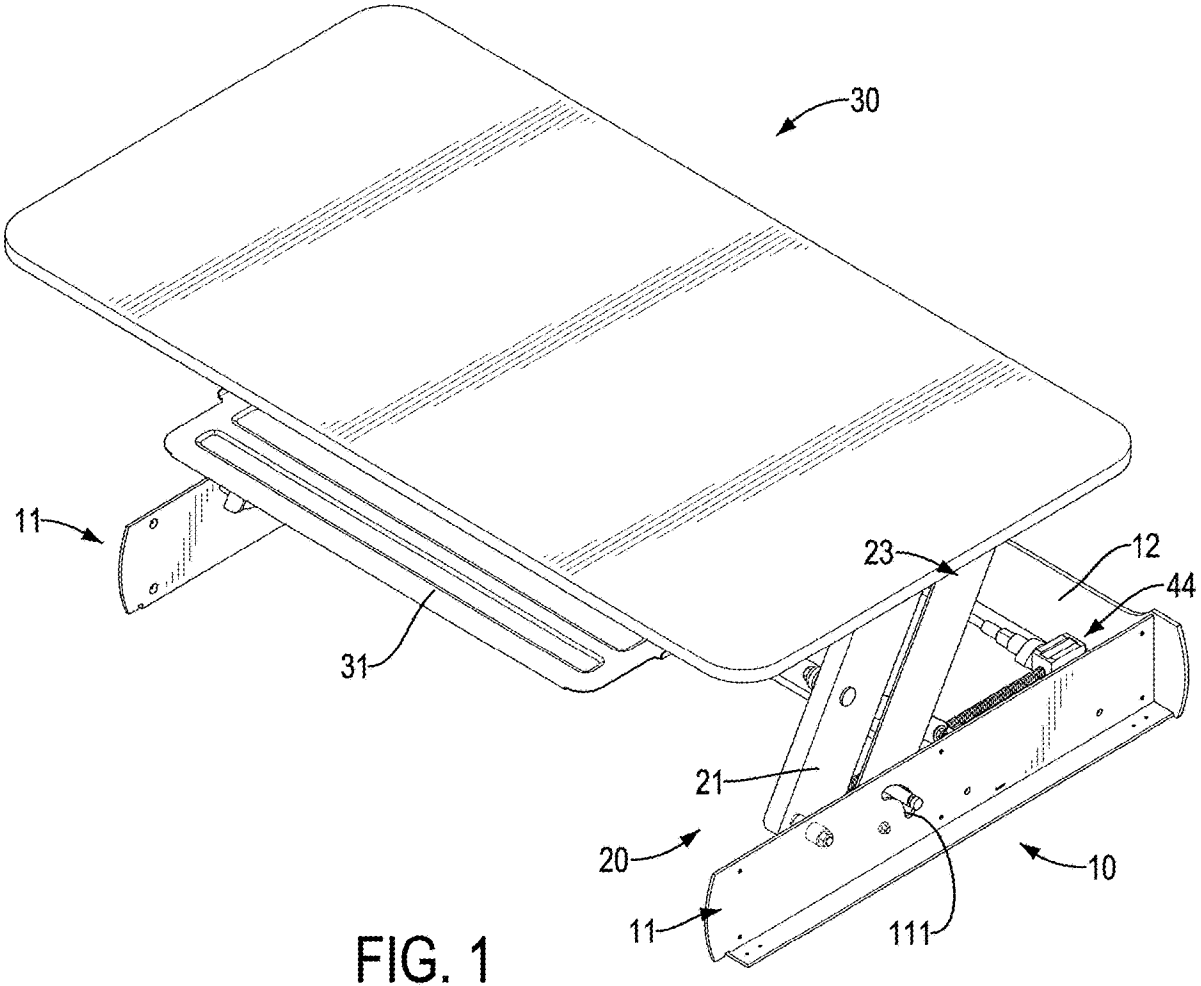
FIG. 1 is a perspective view of a desktop liftable platform in accordance with the present invention.
Figure 2:
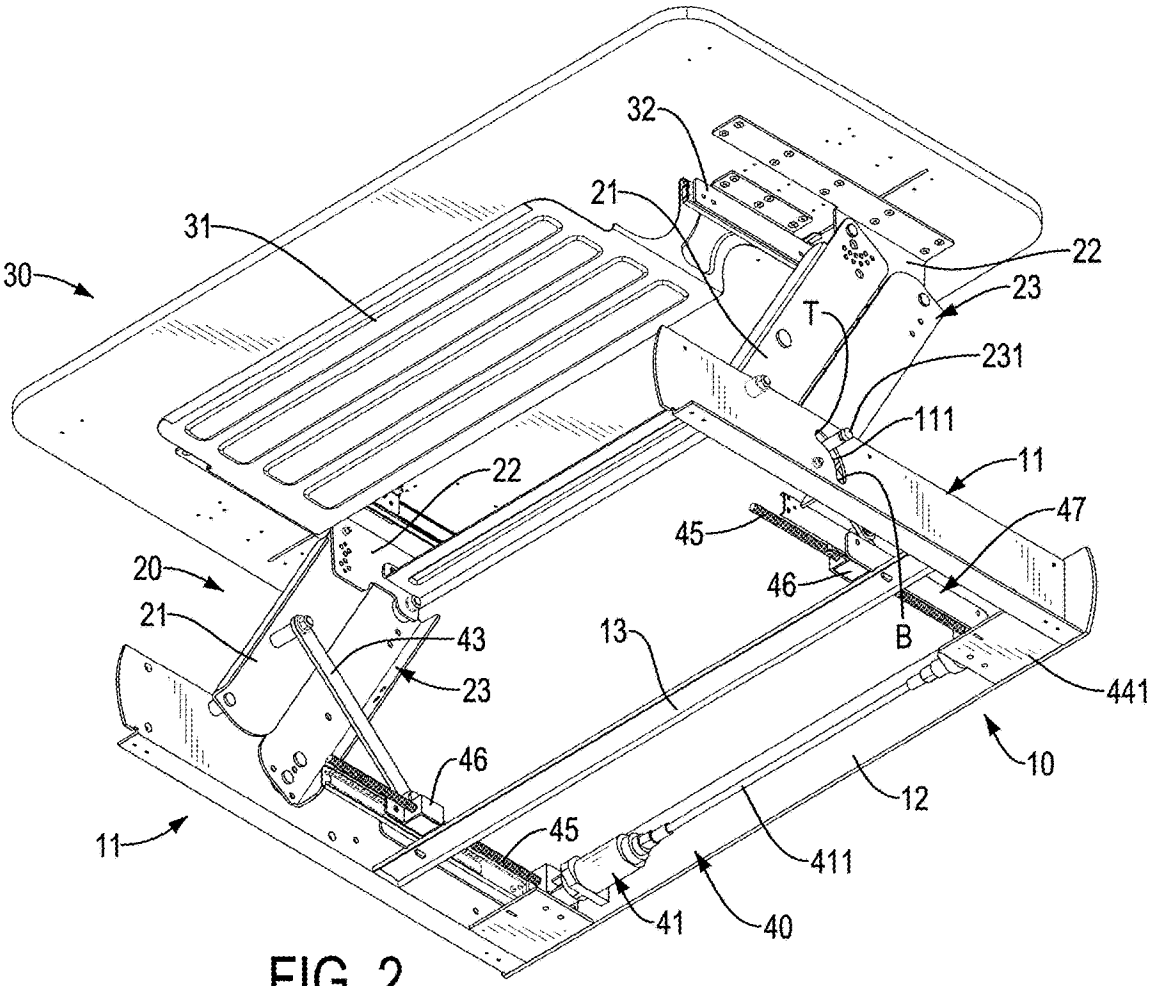
FIG. 2 is another perspective view of the desktop liftable platform in FIG. 1.
Figure 3:
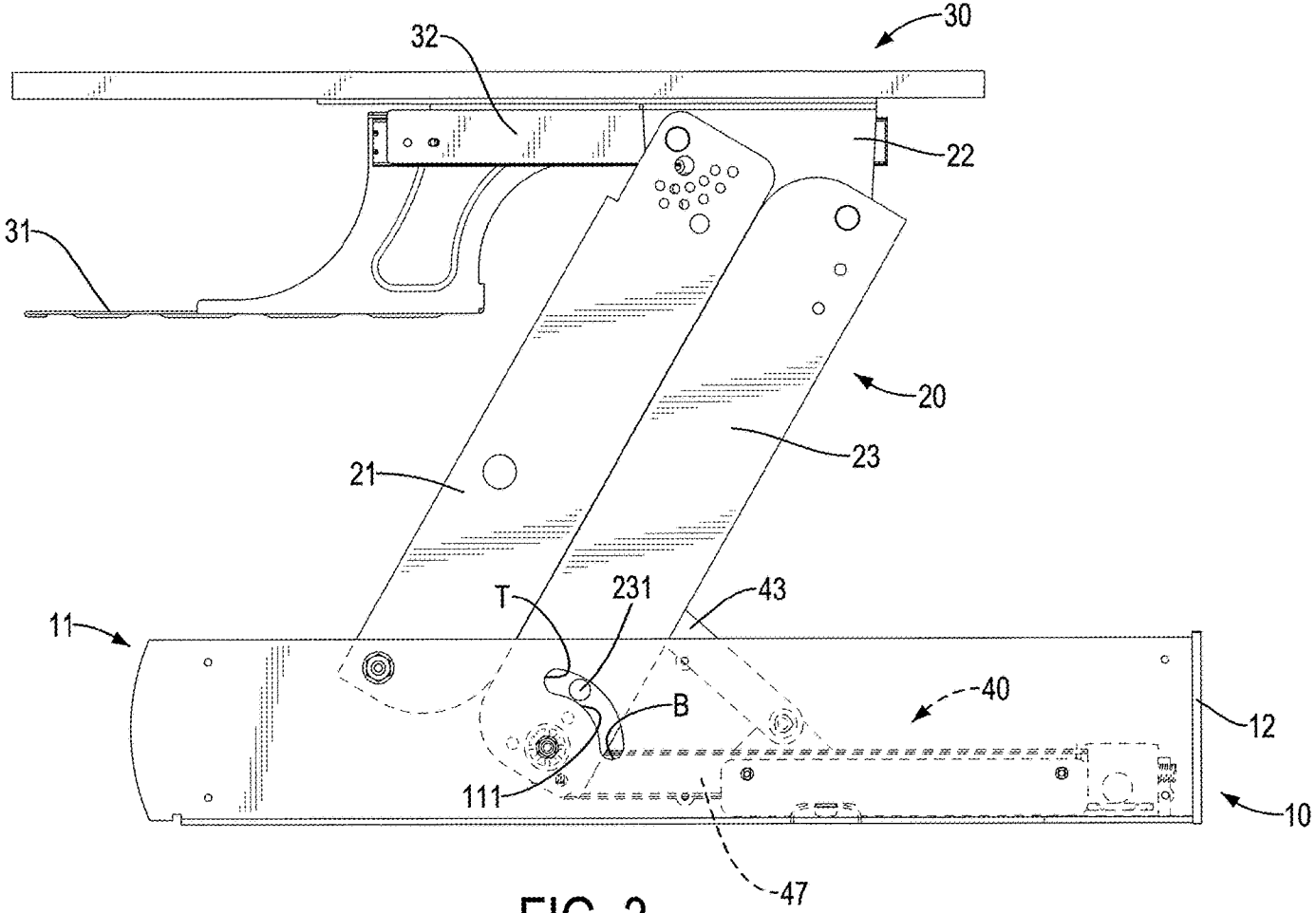
FIG. 3 is a side perspective view of the desktop liftable platform in FIG. 1.
Figure 4:
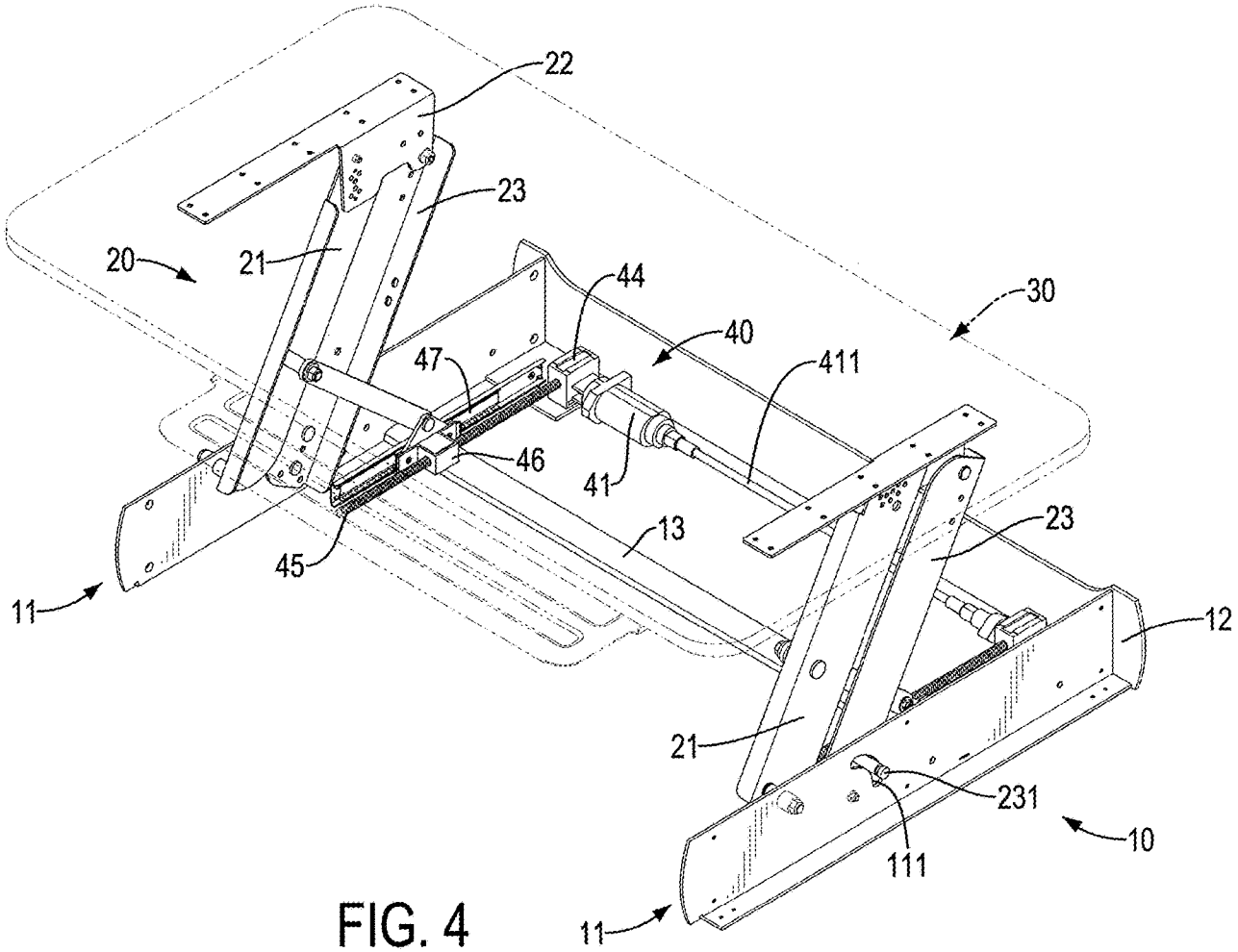
FIG. 4 is a perspective view of the desktop liftable platform in FIG. 1, shown with some components hidden.
Figure 5:
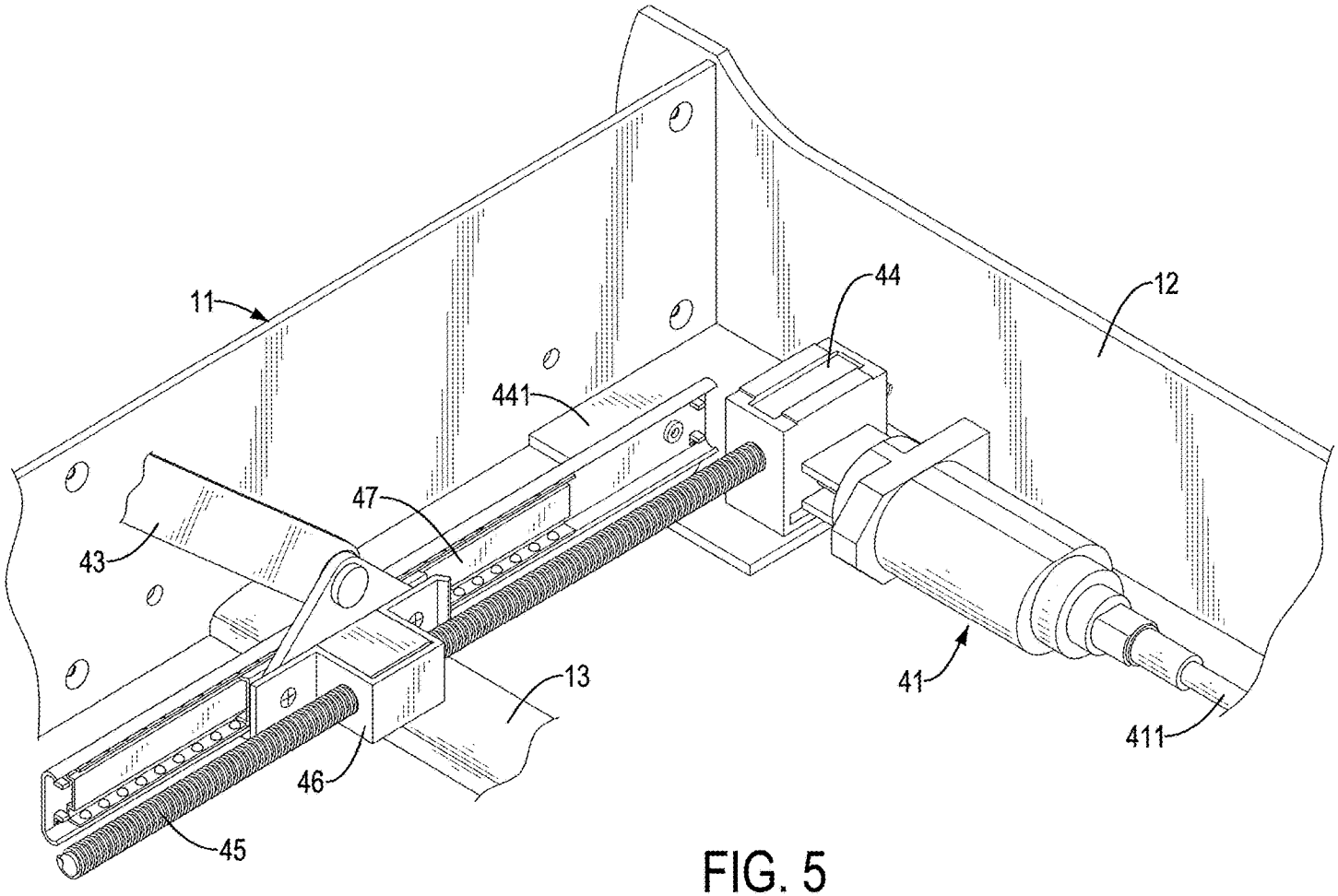
FIG. 5 is an enlarged perspective view of the desktop liftable platform in FIG. 4.
Figure 6:
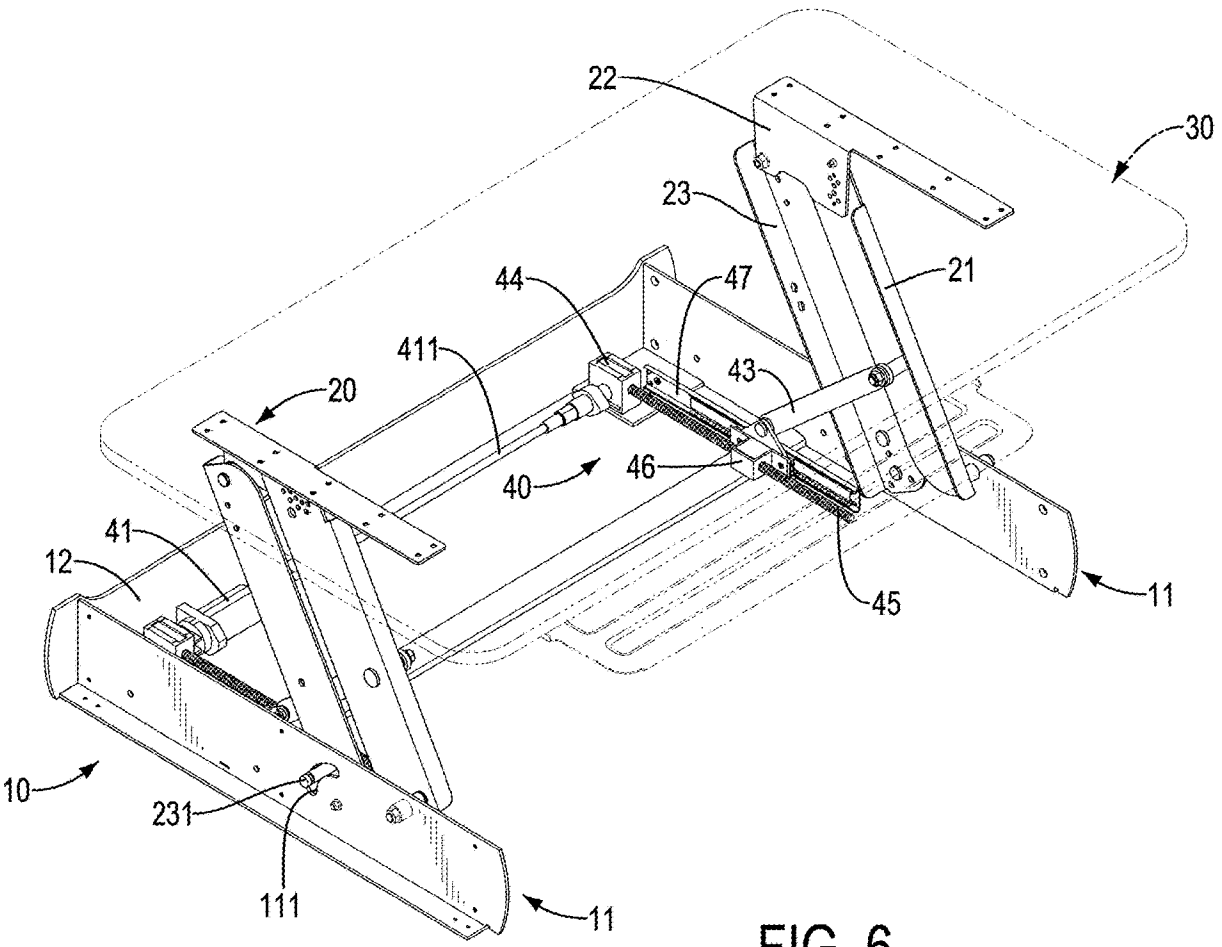
FIG. 6 is another perspective view of the desktop liftable platform in FIG. 1, shown with some components hidden.
Figure 7:
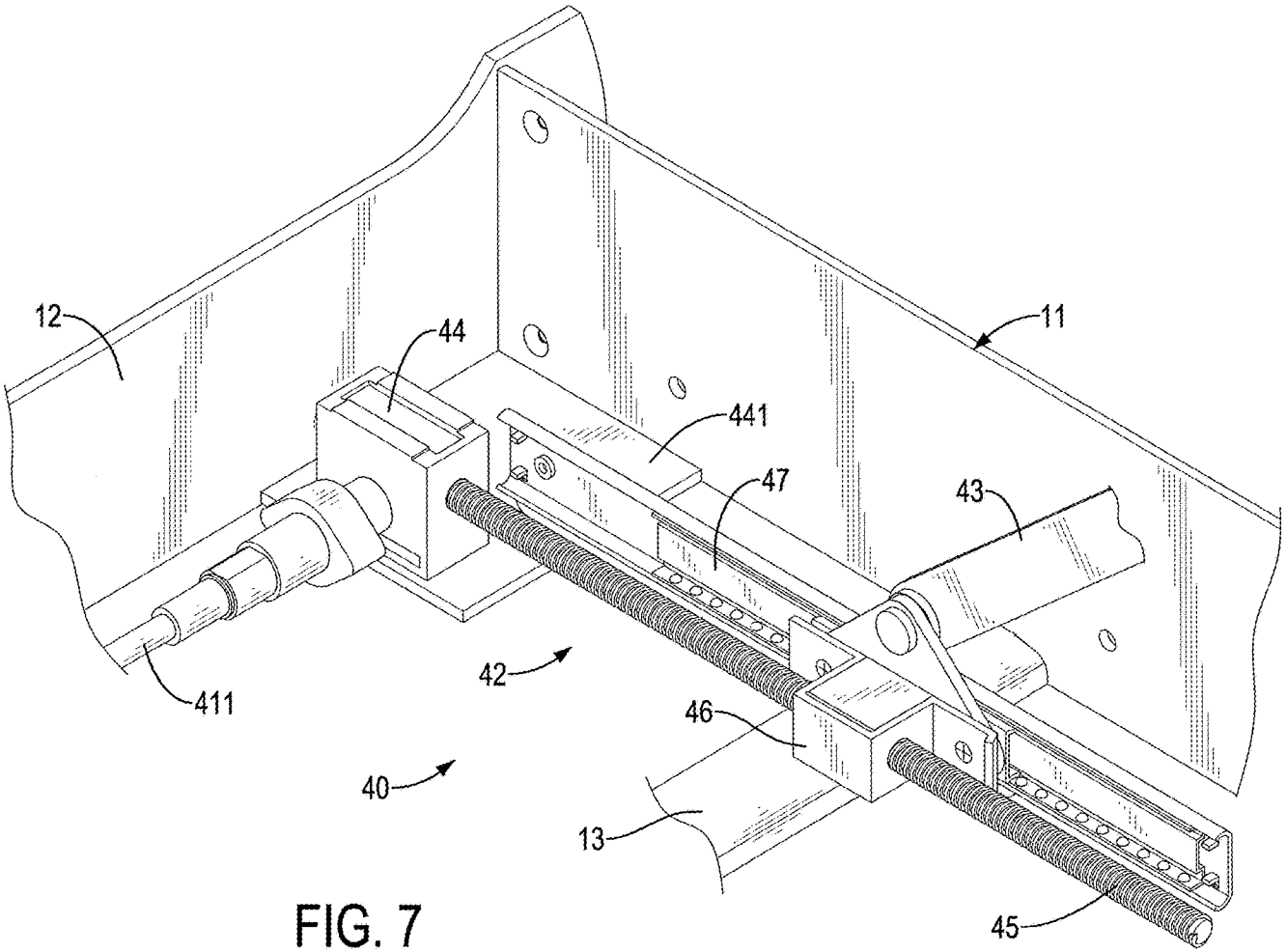
FIG. 7 is an enlarged perspective view of the desktop liftable platform in FIG. 6.

With reference to FIGS. 1 to 3, a desktop liftable platform in accordance with the present invention may be deposited on a top of a table for placing a computer, and the desktop liftable platform comprises a base 10, a supporting frame 20, a platform 30, and a driving device 40.

The base 10 may be U-shaped and has two side beams 11, a connecting beam 12, and at least one linking beam 13. The side beams 11 are parallel with each other at a spaced interval, and each one of the side beams 11 has a rear end, a middle, a front end, and a guiding slot 111. With further reference to FIG. 3, the guiding slot 111 is transversally formed through the side beam 11 adjacent to the middle of the side beam 11. Furthermore, the guiding slot 111 has a lower starting point B and an upper starting point T. The connecting beam 12 is connected to the rear ends of the side beams 11. The at least one linking beam 13 is connected to the side beams 11 and is parallel with the connecting beam 12.

The supporting frame 20 is connected to the base 10 and has two pivot arms 21, two holding panels 22, and two guiding arms 23. Each one of the pivot arms 21 has a bottom end and a top end. The bottom end of one of the pivot arms 21 is connected to a corresponding one of the side beams 11 of the base 10 adjacent to the front end of the corresponding side beam 11, and the bottom end of the other one of the pivot arms 21 is connected to the other one of the side beams 11 of the base 10 adjacent to the front end of the corresponding side beam 11. One of the holding panels 22 is pivotally connected to the top end of one of the pivot arms 21, and the other one of the holding panels 22 is pivotally connected to the top end of the other one of the pivot arms 21.

The guiding arms 23 are connected to the holding panels 22, are parallel with the pivot arms 21, and each one of the guiding arms 23 has a top end, a bottom end, and a limiting rod 231. The top end of one of the guiding arms 23 is pivotally connected to one of the holding panels 22, and the bottom end of the guiding arm 23 is deposited adjacent to the bottom end of the pivot arm 21 that is pivotally connected to the corresponding holding panel 22. The limiting rod 231 is deposited on and transversally protrudes from the bottom end of the guiding arm 23, is inserted through the guiding slot 111 of the side beam 11 that is connected to the corresponding pivot arm 21, and moves along the guiding slot 111 between the lower starting point B and the upper starting point T of the guiding slot 111.

The platform 30 is connected to the supporting frame 20 over the base 10, may move toward or away from the base 10 by the supporting frame 20 to adjust a height of the platform 30 relative to the base 10, and has a bottom, a front edge, a shelf 31, and two slide rails 32. The bottom of the platform 30 is securely connected to the holding panels 22, and this enables the platform 30 to move upwardly or downwardly relative to the base 10 by a movement of the pivot arms 21 of the supporting frame 20. The shelf 31 is deposited on the bottom of the platform 30 adjacent to the front edge of the platform 30 for placing a keyboard or other objects. The slide rails 32 are deposited on the bottom of the platform 30 beside the shelf 31, and are connected to the shelf 31 to enable the shelf 31 to move relative to the platform 30.

With reference to FIGS. 4 to 7, the driving device 40 is connected to the base 10 and the supporting frame 20 to move the platform 30 upwardly or downwardly relative to and parallel with the base 10. The driving device 40 has a driving motor 41, two slide groups 42, and two swing arms 43. The driving motor 41 is deposited on the base 10 and has a driving shaft 411. The driving shaft 411 is rotatably deposited on the base 10 adjacent to the connecting beam 12 between the side beams 11. The slide groups 42 are deposited on the base 10, are connected to the driving motor 41, and each one of the slide groups 42 has a transmission box 44, a lead screw 45, and a mounting sheath 46.

The transmission box 44 is deposited on the base 10, is connected to the driving shaft 411 to transmit the power that is generated by the driving motor 41, and has a connecting tab 441. The connecting tab 441 is connected to one of the side beams 11 and the connecting beam 12 to hold the transmission box 44 at a corner of the base 10 that is formed by the corresponding side beam 11 and the connecting beam 12. Furthermore, a bevel gear may be deposited in the transmission box 44 and is connected to the driving shaft 411 of the driving motor 41.

The lead screw 45 is connected to the transmission box 44 to transmit the power of the driving motor 41, and has an inner end and an outer end. The inner end of the lead screw 45 is mounted in and engages with the bevel gear of the transmission box 44 to transmit the power of the driving motor 41 to the lead screw 45 via the driving shaft 411 and the bevel gear of the transmission box 44. Then, the lead screw 45 is driven by the driving motor 41 to rotate relative to the transmission box 44. The outer end of the lead screw 45 extends toward the front ends of the side beams 11 of the base 10.

The mounting sheath 46 is slidably mounted on and engages with the lead screw 45, and is moved relative to the lead screw 45 between the inner end and the outer end of the lead screw 45 when the lead screw 45 is rotated. Furthermore, the mounting sheaths 46 of the slide groups 42 are driven by the driving motor 41 to move synchronously on the lead screws 45 of the slide groups 42.

The swing alms 43 are connected to the supporting frame 20 and the slide groups 42, and each one of the swing arms 43 has a top end and a bottom end. The top end of the swing arm 43 is connected to one of the pivot arms 21, and the bottom end of the swing arm 43 is connected to the mounting sheath 46 of one of the slide groups 42 that is adjacent to the corresponding pivot atm 21. Then, the swing arms 43 are moved with the mounting sheaths 46 of the slide groups 42 to enable the pivot arms 21 to rotate relative to the base 10, and the platform 30 may move upwardly or downwardly relative to the base 10 via the pivot anus 21.

Additionally, the driving device 40 has two guiding tracks 47, and each one of the guiding tracks 47 is connected to the at least one linking beam 13 and the connecting tab 441 of a corresponding one of the transmission boxes 44 at a side of the lead screw 45 that is connected to the corresponding transmission box 44, and is connected to the mounting sheath 46 that is mounted on the corresponding lead screw 45. Then, the mounting sheath 46 may move steadily relative to the corresponding lead screw 45 by the corresponding guiding track 47. Furthermore, since the mounting sheaths 46 may move steadily with the guiding tracks 47, the pivot arms 21 may rotate synchronously and steadily relative to the base 10 via the swing arms 43. Therefore, the platform 30 may smoothly move up or down relative to the base 10, and the height of the platform 30 relative to the base 10 can be changed and adjusted.

Figure 8:
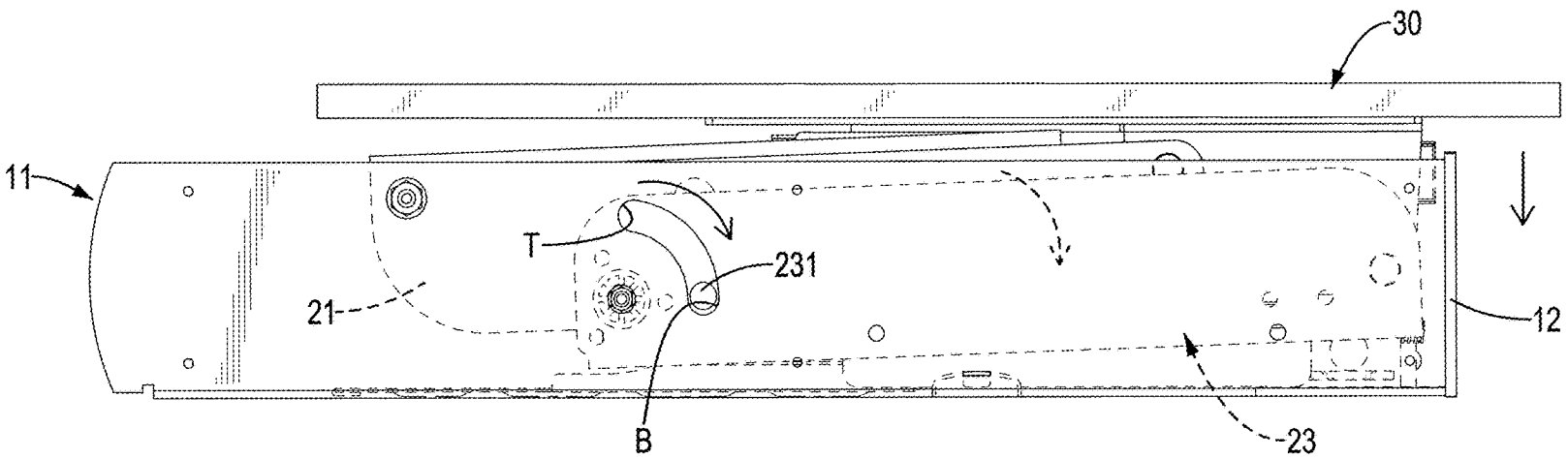
FIG. 8 is an operational side view of the desktop liftable platform in FIG. 1, under a lowered condition.

With reference to FIGS. 2, 3, and 8, in use, the improved desktop liftable platform is deposited on the top of the table, when the driving motor 41 is started to drive the driving shaft 411 to rotate, the power that is generated by the driving motor 41 is transmitted to rotate the lead screws 45 via the driving shaft 411 and the transmission boxes 44. Then, the mounting sheaths 46 are moved toward the transmission boxes 44 along the lead screws 45, and this enables the pivot arms 21 to rotate with the swing arms 43 relative to the base 10, and the platform 30 is move downwardly toward the base 10 under a lowered condition. Additionally, when the platform 30 is moved toward the base 10, the guiding anus 23 are rotated with the pivot arms 21 and the platform 30 relative to the base 10, and each one of the limiting rods 231 is moved to the lower starting point B of the corresponding guiding slot 111. Consequently, the platform 30 is moved into the base 10 as shown in FIG. 8.

Figure 9:
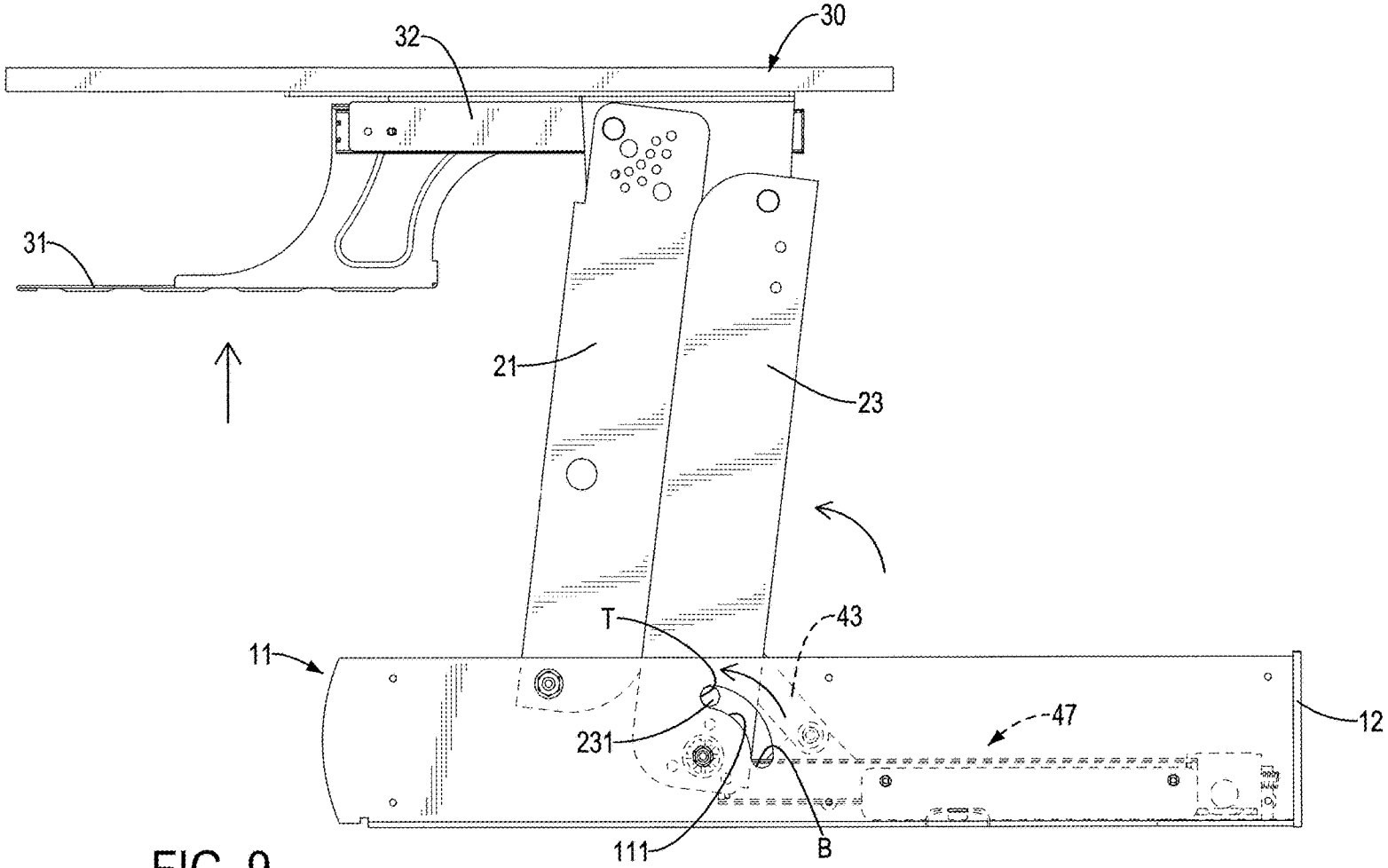
FIG. 9 is an operational side view of the desktop liftable platform in FIG. 1, under a lifted condition.

With reference to FIG. 9, when the mounting sheaths 46 are moved away from the transmission boxes 44, the pivot arms 21 are rotated with the movement of the mounting sheaths 46 relative to the base 10 via the swing arms 43, and the platform 30 is moved upwardly relative to the base 10. Furthermore, when the platform 30 is moved upwardly relative to the base 10, the guiding arms 23 are rotated with the pivot arms 21 and the platform 30 relative to the base 10, and each one of the limiting rods 231 is moved to the upper starting point T of the corresponding guiding slot 111. Consequently, a distance between the platform 30 and base 10 can be changed and adjusted as shown in FIG. 9.

According to the above-mentioned structures and features of the desktop liftable platform in the present invention, the driving motor 41 may drive the pivot arms 21 to rotate relative to the base 10 via the slide groups 42 and the swing arms 43, and the platform 30 may move upwardly or downwardly relative to the base 10 under a parallel condition and to change the height of the platform 30 relative to the base 10. Then, people of different heights and sizes can use the desktop liftable platform on the table according to the needs by adjusting the height of the platform 30 relative to the base 10.

In addition, when the user wants to operate the computer, to read or to work with a standing posture, the platform 30 can be moved upwardly to change the height of the platform 30 relative to the base 10, and this may prevent the user from using the computer with the sitting posture for a long time and may avoid causing damages to the user's health, poor blood circulation in the lower limb of the user, and the cardiovascular diseases.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A desktop liftable platform comprising:

a base having two side beams, and each one of the side beams having a rear end, a middle, and a front end; and a connecting beam connected to the rear ends of the side beams;

a supporting frame connected to the base and having two pivot arms, and each one of the pivot arms having a bottom end connected to a corresponding one of the side beams of the base adjacent to the front end of the corresponding side beam; and a top end;

a platform connected to the pivot arms of the supporting frame over the base; and a driving device connected to the base and the supporting frame, and having a driving motor deposited on the base;

two slide groups deposited on the base, and connected to and driven by the driving motor; and two swing arms connected to the pivot arms of the supporting frame and the slide groups, and rotated relative to the base by the driving motor to enable the platform to move upwardly or downwardly relative to the base.

2. The desktop liftable platform as claimed in claim 1, wherein the supporting frame has two holding panels, and one of the holding panels is pivotally connected to the top end of one of the pivot arms, and the other one of the holding panels is pivotally connected to the top end of the other one of the pivot arms; and the platform has a bottom securely connected to the holding panels of the supporting frame.

3. The desktop liftable platform as claimed in claim 1, wherein each one of the side beams has a guiding slot transversally formed through the side beam adjacent to the middle of the side beam, and the guiding slot having a lower starting point and an upper starting point; and the supporting frame has two guiding arms connected to the holding panels and parallel with the pivot arms, and each one of the guiding arms has a top end pivotally connected to one of the holding panels;

a bottom end deposited adjacent to the bottom end of the pivot arm that is pivotally connected to the corresponding holding panel; and a limiting rod deposited on and transversally protruding from the bottom end of the guiding arm, inserted through the guiding slot of the side beam that is connected to the corresponding pivot arm, and moved along the guiding slot between the lower starting point and the upper starting point of the guiding slot.

4. The desktop liftable platform as claimed in claim 1, wherein the platform has a bottom;

a front edge;

a shelf deposited on the bottom of the platform adjacent to the front edge of the platform; and two slide rails deposited on the bottom of the platform beside the shelf, and connected to the shelf to enable the shelf to move relative to the platform.

5. The desktop liftable platform as claimed in claim 1, wherein the driving motor has a driving shaft rotatably deposited on the base adjacent to the connecting beam between the side beams; and each one of the slide groups has a transmission box deposited on the base, and connected to the driving shaft to transmit the power that is generated by the driving motor;

a lead screw connected to the transmission box to transmit the power of the driving motor, and having an inner end mounted in and engaging with the transmission box to transmit the power of the driving motor to the lead screw via the driving shaft and the transmission box; and an outer end extending toward the front end of one of the side beams of the base; and a mounting sheath slidably mounted on and engaging with the lead screw, and moved relative to the lead screw between the inner end and the outer end of the lead screw when the lead screw is rotated.

6. The desktop liftable platform as claimed in claim 5, wherein each one of the swing arms has a top end connected to a corresponding one of the pivot arms; and a bottom end connected to the mounting sheath of one of the slide groups that is adjacent to the corresponding pivot arm;

wherein the swing arms are moved with the mounting sheaths of the slide groups to enable the pivot arms to rotate relative to the base, and the platform is moved upwardly or downwardly relative to the base via the pivot arms.

7. The desktop liftable platform as claimed in claim 5, wherein the transmission box of each one of the slide groups has a connecting tab connected to a corresponding one of the side beams and the connecting beam to hold the transmission box at a corner of the base that is formed by the corresponding side beam and the connecting beam.

8. The desktop liftable platform as claimed in claim 6, wherein the transmission box of each one of the slide groups has a connecting tab connected to a corresponding one of the side beams and the connecting beam to hold the transmission box at a corner of the base that is formed by the corresponding side beam and the connecting beam.

9. The desktop liftable platform as claimed in claim 7, wherein the base has at least one linking beam connected to the side beams and being parallel with the connecting beam; and the driving device has two guiding tracks, and each one of the guiding tracks is connected to the at least one linking beam and the connecting tab of a corresponding one of the transmission boxes at a side of the lead screw that is connected to the corresponding transmission box, and is connected to the mounting sheath that is mounted on said lead screw.

10. The desktop liftable platform as claimed in claim 8, wherein the base has at least one linking beam connected to the side beams and being parallel with the connecting beam; and the driving device has two guiding tracks, and each one of the guiding tracks is connected to the at least one linking beam and the connecting tab of a corresponding one of the transmission boxes at a side of the lead screw that is connected to the corresponding transmission box, and is connected to the mounting sheath that is mounted on said lead screw.

* * * * *